US010278523B2

(12) United States Patent
Ringel

(10) Patent No.: US 10,278,523 B2
(45) Date of Patent: May 7, 2019

(54) SHELF-LIT SHELVING UNIT

(71) Applicant: Nissan Ringel, Brooklyn, NY (US)

(72) Inventor: Nissan Ringel, Brooklyn, NY (US)

( * ) Notice: Subject to any disclaimer, the term of this patent is extended or adjusted under 35 U.S.C. 154(b) by 73 days.

(21) Appl. No.: 15/411,293

(22) Filed: Jan. 20, 2017

(65) Prior Publication Data

US 2017/0202372 A1 Jul. 20, 2017

Related U.S. Application Data

(60) Provisional application No. 62/280,913, filed on Jan. 20, 2016.

(51) Int. Cl.

| | |
|---|---|
| ***A47F 5/00*** | (2006.01) |
| ***A47F 5/08*** | (2006.01) |
| ***A47B 57/10*** | (2006.01) |
| ***A47B 57/34*** | (2006.01) |
| ***A47B 96/02*** | (2006.01) |
| ***A47B 96/06*** | (2006.01) |
| ***A47B 97/00*** | (2006.01) |
| ***A47F 11/10*** | (2006.01) |
| ***F21Y 103/10*** | (2016.01) |
| ***F21Y 115/10*** | (2016.01) |
| ***F21W 131/301*** | (2006.01) |

(52) U.S. Cl.

CPC ..... *A47F 11/10* (2013.01); *A47B 57/10* (2013.01); *A47B 57/34* (2013.01); *A47B 96/028* (2013.01); *A47B 96/066* (2013.01); *A47B 97/00* (2013.01); *A47F 5/0043* (2013.01); *A47F 5/08* (2013.01); *A47B 2220/0077* (2013.01); *F21W 2131/301* (2013.01); *F21Y 2103/10* (2016.08); *F21Y 2115/10* (2016.08)

(58) Field of Classification Search

CPC ..... F25D 27/00; F21W 2131/301; F21S 4/20; F21S 4/28; A47B 2220/0077; A47B 2220/0075

USPC ..... 362/127

See application file for complete search history.

(56) References Cited

U.S. PATENT DOCUMENTS

| | | | | |
|---|---|---|---|---|
| 4,112,485 | A * | 9/1978 | Sutter | F21L 4/00 362/369 |
| 6,179,434 | B1 * | 1/2001 | Saraiji | A47F 3/001 108/23 |
| 8,439,418 | B1 * | 5/2013 | Lovejoy | B60R 7/06 296/37.12 |
| 2001/0036070 | A1 * | 11/2001 | Compagnucci | A47B 77/00 362/127 |

(Continued)

*Primary Examiner* — William N Harris

(74) *Attorney, Agent, or Firm* — McCarter & English LLP

(57) ABSTRACT

The present disclosure relates to shelving units, more particularly shelving units having a lighting component that illuminates a product and/or provides ambient light. According to some aspects of the present disclosure, the shelf could be made from a transparent material and could include a lighting strip disposed in a groove in a front edge of the shelf. A power connector is provided for receiving power from a power supply. A reflective laminate could be disposed on top, front, rear, and lateral sides of the shelf. A second laminate could be disposed over the reflective laminate. A bottom surface of the shelf could be altered to evenly scatter light from the lighting strip. According to further aspects of the present disclosure, a floating shelf having a top layer, a bottom layer, and spacers, and a mounting bracket having a wall harness, hinges, and support rods are provided.

5 Claims, 12 Drawing Sheets

(56) References Cited

U.S. PATENT DOCUMENTS

| | | | | |
|---|---|---|---|---|
| 2006/0181885 | A1* | 8/2006 | Seng Tong | A47B 96/02 362/382 |
| 2007/0217191 | A1* | 9/2007 | Tsai | A47G 33/06 362/237 |
| 2009/0021927 | A1* | 1/2009 | Hall | F25D 25/02 362/92 |
| 2010/0133208 | A1* | 6/2010 | Seo | A47B 23/04 211/26 |
| 2011/0273867 | A1* | 11/2011 | Horst | A47B 96/021 362/133 |
| 2012/0043338 | A1* | 2/2012 | Yang | F25D 25/02 220/592.02 |
| 2015/0023000 | A1* | 1/2015 | Kendall | F25D 27/00 362/92 |
| 2015/0279251 | A1* | 10/2015 | Matyear | H02S 40/38 362/183 |

* cited by examiner

SHELF-LIT SHELVING UNIT

CROSS-REFERENCE TO RELATED APPLICATION

This application is a Continuation-In-Part application of, and claims priority to, U.S. Provisional Patent Application No. 62/280,913, filed on Jan. 20, 2016, the entire contents of which are hereby incorporated by reference.

BACKGROUND

Field of the Disclosure

The present disclosure relates to shelving units, more particularly shelving units having a lighting component that illuminates a product and/or provides ambient light.

Related Art

Shelving units are commonly used to display items, whether in commercial establishments or private residences. When multiple shelves are present, the presence of the shelving above the item commonly shields the item from light, making it more difficult to see the item being displayed.

The most common way of solving this issue is by use of lighting. Currently, spotlights are often used. When used with a glass shelves, light often does not reach the lower shelves, meaning that only items at or near eye level are usually seen. Furthermore, such lights have a limited diameter of light and thus will typically only light one item or a small number of items on the shelf, thereby requiring attachment of several different lighting units to the shelf above.

Furthermore, even without a shelf above an item, to properly light an item a lighting fixture must be attached to the wall or some other structure. Similarly, to increase the diameter of effective light of spotlights, the spotlights must be attached to some structure separate from the shelving units, such as a ceiling or wall. Even still, shadows and dark areas will still be present on the shelf.

Some display systems have used LED strips in cabinets, but this can cause each individual LED to be reflected in the product and take away from its look. Similar to the spotlight systems, shadows, dark areas, and bright spots are still an issue.

Wood and metal shelving have long been used, but such shelving units do not allow light through them and thus it is more difficult to light a product effectively.

Other prior attempts at a lit shelf have involved special hardware needed to install the shelf to the wall, or require separate power for each shelf, making it inefficient particularly for commercial display. It would be advantageous if there were a shelf that provided light while being installable in existing shelving systems, and allows the use of differently dimensioned shelves or a different number of shelves without the need for additional electrical infrastructure.

BRIEF DESCRIPTION OF THE DRAWINGS

The foregoing features of the disclosure will be apparent from the following Detailed Description, taken in connection with the accompanying drawings, in which.

SUMMARY

Figure 1:
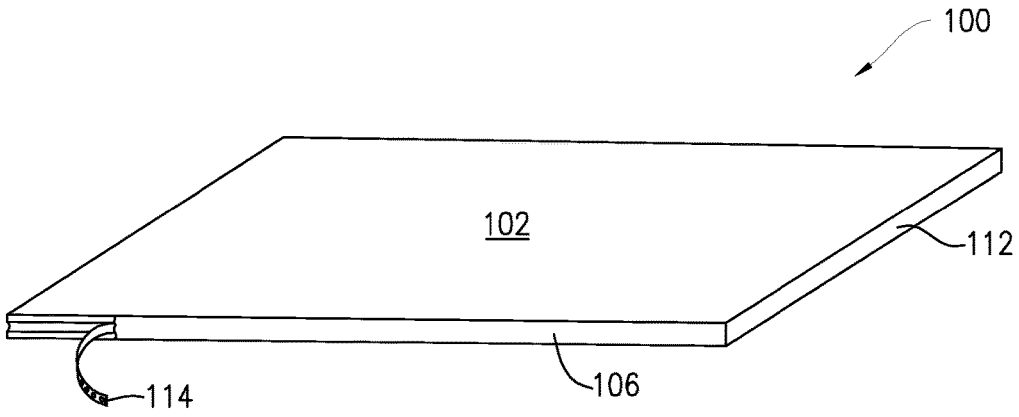
FIG. 1 is a top front perspective view of a self-lit fixed shelf.

The present disclosure relates to shelving units, more particularly shelving units having a lighting component that illuminates a product and/or provides ambient light.

According to some aspects of the present disclosure, the shelf could include a top side, a bottom side, a front side, a rear side, a left side, and a right side. The bottom side of the shelf is comprised of a material that is clear or sufficiently clear enough such that light travels through the shelf rather than experiencing significant distortion or scattering. The bottom side of the shelf could be altered such that the bottom side is transparent or translucent and the light could scatter evenly down.

The shelf includes a lighting strip along a side of the shelf. The lighting strip faces inward toward the shelf, sending the light through the shelf. The lighting strip could include light-emitting diodes. The top, front, back, and lateral sides of the shelf could be laminated to reflect the light downward. The lighting strip could have a female connector for connecting the lighting strip to a power supply. Additional connectors could be provided for supplying power to additional shelves.

According to further aspects of the present disclosure a surface mounted light for a shelf is provided. The light could be mounted to a desired surface (e.g., an underside of a wall-mounted shelf) using a adhesive or other suitable surface-mounting means. The light could have a top side, bottom side, front side, rear side, left side, and right side. The light can be formed from any material that is clear or sufficiently clear enough such that light provided by a lighting source, travels throughout the material without experiencing significant distortion or scattering. In order to diffuse light output, the bottom side could be altered such that the light is scattered evenly down.

The surface mounted light could include an LED lighting strip disposed along the front side of the light. The LED lighting strip could include white lights or a variety of shades of white, and/or a combination of colors. The light could include a female connector at a rear corner and/or side of the light where a power supply or an additional light unit could be connected.

The surface mounted light could have a front groove (e.g., chamfer) along a top front edge thereof. The LED light strip could be secured in the front groove such as by using a suitable adhesive or otherwise. The female power connector can be affixed to the light in a variety of different positions. The top side of the light can be laminated to reflect the light downward.

According to further aspects of the invention, a lighted floating shelf is provided. The floating shelf could include a bottom layer having a groove along an edge for receiving a lighting strip. A top layer could be positioned over the bottom layer, with one or more spacers therebetween. The top layer, bottom layer, and spacers could define a pocket therebetween. A power jack could be positioned on an inner surface of one of the spacers, and electrical wiring could be fed through the spacer to the lighting strip. The floating shelf could include a mounting groove which extends laterally between the left and right sides of the floating shelf. The profile of the mounting groove could be sized and shaped to receive and mate with a wall mounting bracket.

According to still further aspects of the present disclosure, a mounting bracket is provided to attach a lighted floating shelf to a wall. The mounting bracket could include a wall harness, hinge, and support rod. The wall harness can be mounted to a wall (e.g., using screws, etc.) on top of an existing standard electrical outlet. The electrical outlets can be accessed through apertures in the wall harness. The wall harness could include a back plate, a lower bracket, and an upper bracket.

The hinge can include a fixed portion and a movable portion. The movable portion can be provided with a threaded aperture for receiving a threaded portion of support rod. The support rod could be provided with the threaded portion on a first end and could have a bumper (e.g., rubber foot) on the opposite end. An angle between the rotatable and fixed portions of the hinge can be adjusted by rotating the support rod. When assembled, the fixed portion of the hinge may be slidably movable parallel to, and along, the back plate.

A lighted floating shelf could be mounted on the mounting bracket. In order mount the floating shelf onto the mounting bracket, the mounting bracket is positioned in the pocket, the upper bracket is received in the mounting groove of the floating shelf, and the support rods are frictionally engaged with the top layer of the floating shelf.

DETAILED DESCRIPTION

The present disclosure relates to a self-lit shelving unit, as discussed in detail below.

Figure 2:
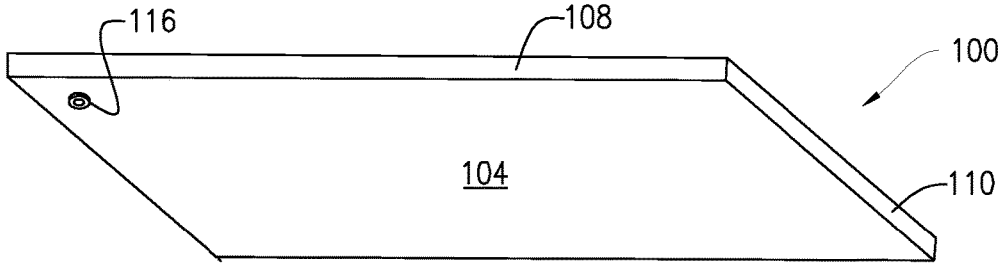
FIG. 2 is a rear back perspective view of the self-lit fixed shelf of FIG. 1.
Figure 3:
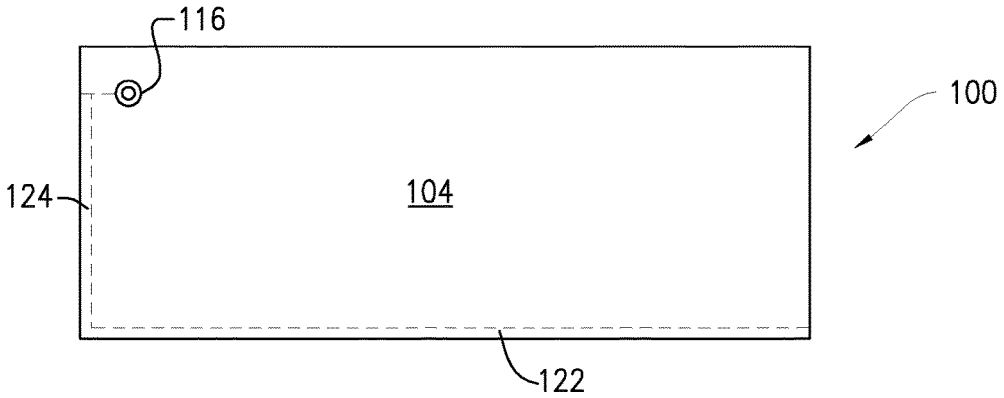
FIG. 3 is a bottom view of the self-lit fixed shelf of FIG. 1.
Figure 4:
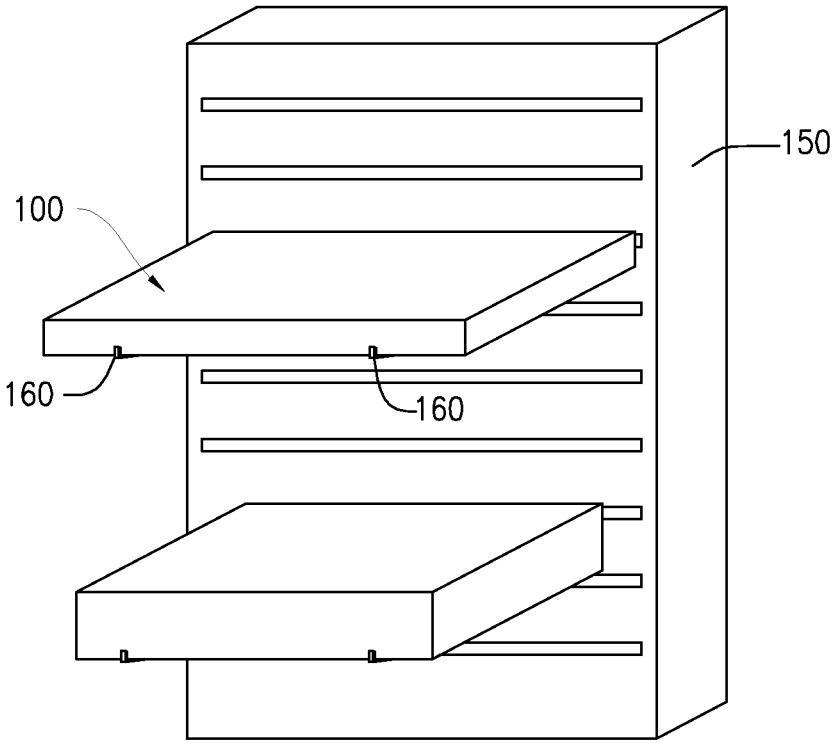
FIG. 4 is a top front perspective view of the self-lit fixed shelf of FIG. 1 mounted to a wall unit using mounting brackets.
Figure 5:
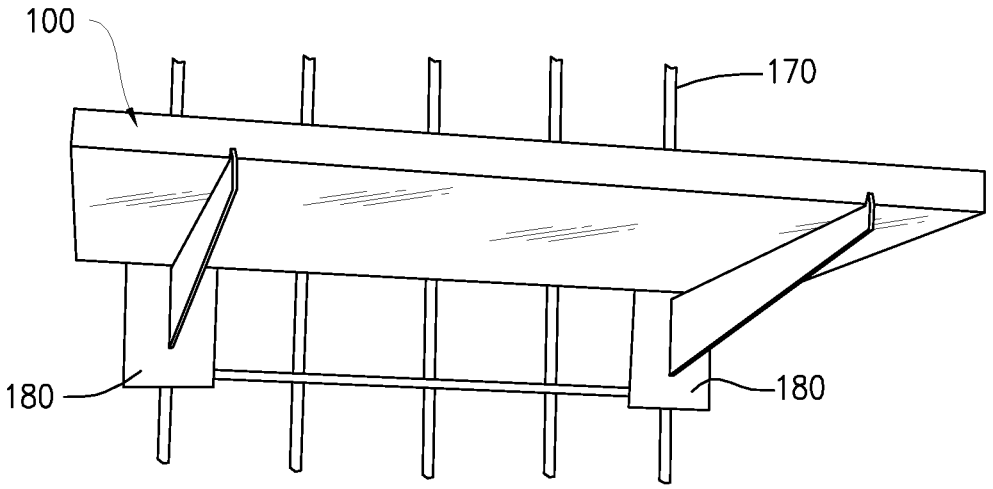
FIG. 5 is a top bottom perspective view of the self-lit fixed shelf of FIG. 1 mounted to a wall unit using mounting brackets.

FIGS. 1-5 are views of a self-lit fixed shelf 100. More specifically, FIG. 1 is a top front perspective view of a self-lit fixed shelf 100, FIG. 2 is a rear back perspective view of the self-lit fixed shelf 100 of FIG. 1, FIG. 3 is a bottom view of the self-lit fixed shelf 100 of FIG. 1, FIG. 4 is a top front perspective view of the self-lit fixed shelf 100 of FIG. 1 mounted to a wall unit 150 using mounting brackets 160, and FIG. 5 is a top bottom perspective view of the self-lit fixed shelf 100 of FIG. 1 mounted to a wall unit 170 using mounting brackets 180.

The shelf 100 could be rectangular or any other suitable shape (e.g., trapezoidal, square, triangular) of any geometry (e.g., having an arced front side). For example, as shown in FIGS. 1 and 2, the shelf 100 could include a top side 102, a bottom side 104, a front side 106, a rear side 108, a left side 110, and a right side 112. The shelf 100 could have any suitable thickness depending on the support requirements of the shelf and/or the dimensions of the mounting unit, depending on needs of the user. For example, the shelf 100 could be about 0.5 inches thick, about 0.75 inches thick, etc.

The bottom side 104 of the shelf 100 is comprised of a material that is clear or sufficiently clear enough such that light travels through the shelf 100 rather than experiencing significant distortion or scattering. The bottom side 104 of the shelf 100 could be altered (e.g., sand blasted, roughened with sandpaper, etc.) such that the bottom side 104 is transparent or translucent and the light could scatter evenly down. For example, the shelf 100 could be made of acrylic, fiberglass, polyurethane, and/or other plastics or materials of sufficient durability and clarity.

The self-lit shelf 100 includes a clear or substantially clear bottom side 104 with an LED lighting strip 114 along a front side 106 of the shelf 100. The LED lighting strip 114 faces inward toward the shelf 100, sending the light through the shelf 100 itself. The top side is laminated with white laminate (e.g., formica), facing down to reflect the light downward and the front side 106, rear side 108, left side 110, and right side 112 are laminated with another laminate. The LED lighting strip 114 could include white lights or a variety of shades of white, and/or a combination of colors (e.g., red, green, blue, etc.), which in combination can give white light or can separately be used to create color effects.

The LED strip 114 has at least one female connector or jack 116 (e.g., 5.5 mm direct current (DC) connector) at each rear corner and/or side of the shelf 100 (see, for example, FIGS. 2 and 3) where a power supply (not shown) could be connected. The connector 116 could utilize any suitable connection type (e.g., 5.5 mm jack, push-in wire connector, etc.) for connecting the LED strip 114 to the power supply. The jack 116 (e.g., 5.5 mm jack) could connect to the jack (e.g., 5.5. mm jack) of another shelving unit, thereby allowing for an expandable system. These connectors 116 (e.g., 5.5. mm connectors) also allow for other shelves to be connected to the shelf 100, allowing several shelving units to be continuous and to operate off of one cord and/or power source, thereby reducing the number of cords or other infrastructure needed to operate a bank of shelves.

Because the strip of LED lights 114 does not add significant bulk to the profile or thickness of the shelf 100, the shelf 100 can be used with many standard shelving systems to replace existing shelves without the need for special hardware in installation. In particular, a system wherein the shelf 100 slides into a slot can be used with the inventive shelf 100. Because no special hardware is needed, the shelf 100 offers a significant advantage over other shelves in ease of installation and less disruption to the retail outlet, as a shelf installation does not necessarily need to be entirely removed in order to use the shelf 100.

A variety of different power sources could be used with the shelf 100. For example, a typical cord with an AC power outlet connection can be used to supply power, a battery, etc. The shelf 100 can be used with preexisting hardware and infrastructure, including to power the lighting of the shelf 100.

The shelf 100 can be set up as a stand-alone unit to attract attention to a particular item in a retail location, or the entire retail location can be provided with shelves 100. The lighting provided by shelf 100 may be sufficient to provide ambient light to the location, particularly when shelf 100 is used throughout a location. Even a single unit of shelf 100 would ensure that the eye is attracted to the items for sale. Shelf 100 can also be used in a residential setting for display of items. One of skill in the art can conceive of numerous other uses for shelf 100 as well as those already discussed.

Figure 16:
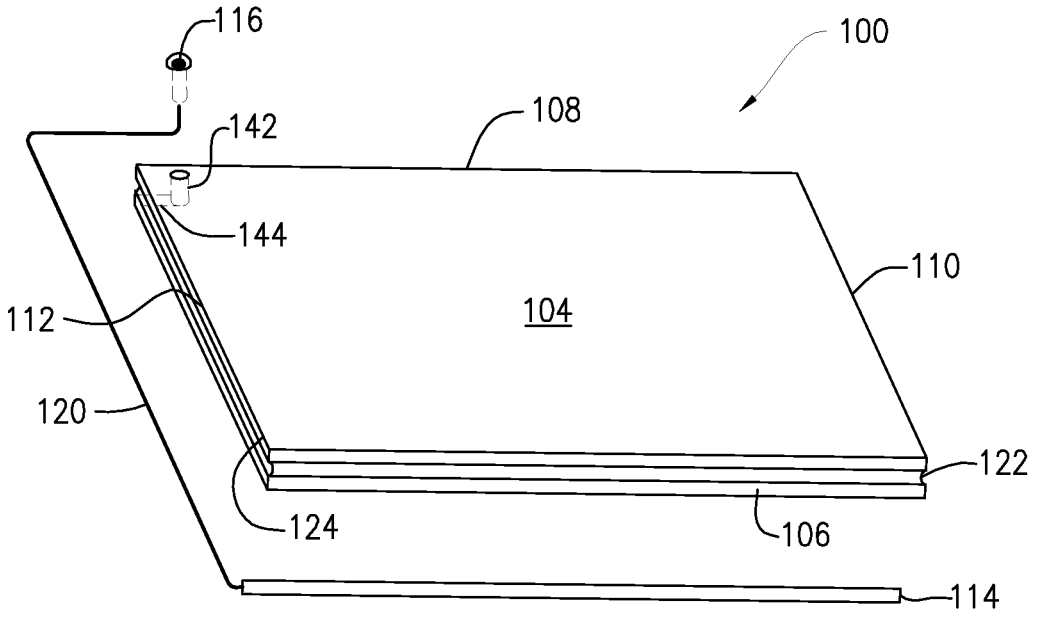
FIG. 16 is a partial bottom exploded view of the self-lit fixed shelf of FIG. 1.
Figure 17:
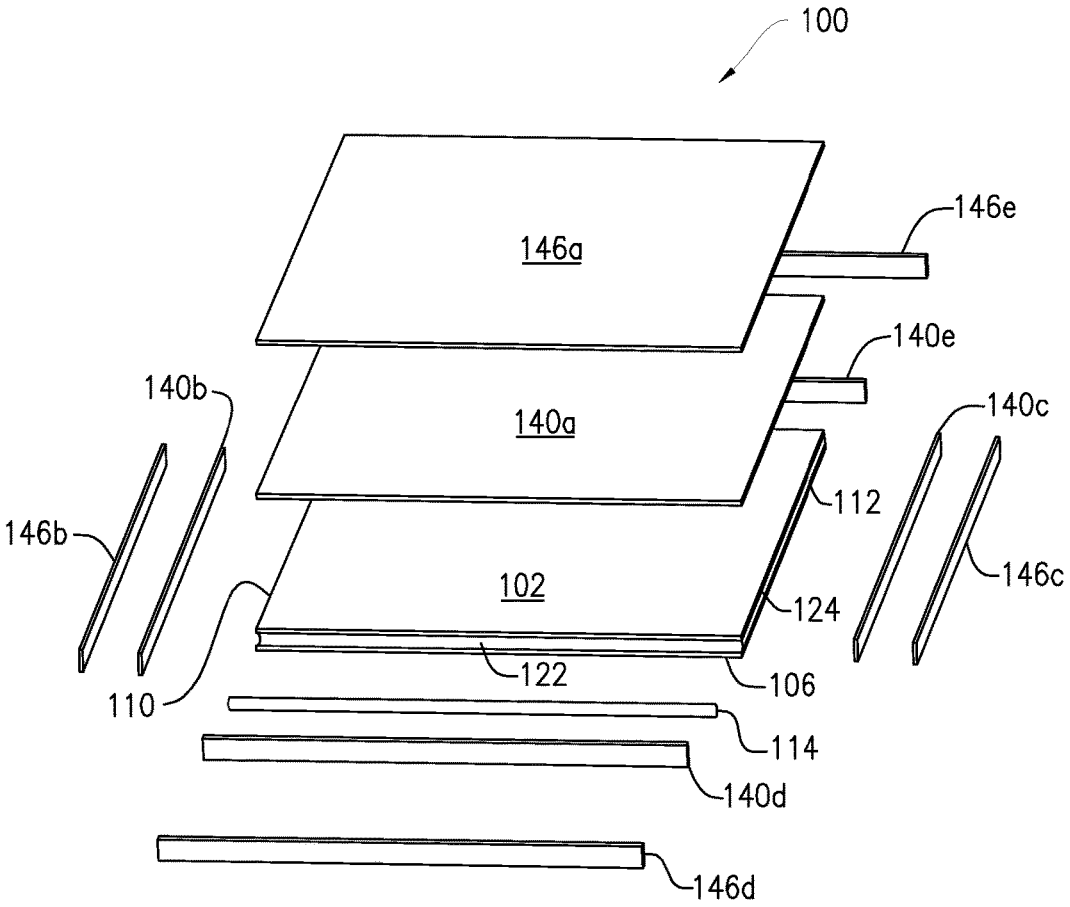
FIG. 17 is a partial top exploded view of the self-lit fixed shelf of FIG. 1.

In an exemplary embodiment, the shelf 100 could use an acrylic "p95" material with a ¼" wide×⅛" deep groove 122, 124 cut into the front side 106 and left and right sides 110, 112 and have a flame polished bottom surface. The LED light 114 could be a 5630 smd LED—white, 38 lm per LED, 60 LEDs per meter, or a 2835 smd LED—white, 120 LEDs per meter, on a 6 mm pcb strip, or any other suitable lighting strip, glued into the front groove 122 facing inwards. According to some aspects of the present disclosure, the LED light strip 114 could be affixed within the groove 122 using a double-sided bonding tape, such as for example, VHB™ adhesive acrylic tape manufactured by the 3M™ Company, or any other suitable double-sided bonding tape or adhesive. As shown in FIGS. 3 and 16, the LED light strip 114 could be glued into the front groove 122 with the supply wire 120 running along the side groove 124 to the 5.5 mm jack 116. As shown in FIG. 17, the shelf 100 could be covered with two (2) layers of laminate; one layer of white color facing inwards to assist in the reflection of the light, and one layer facing outwards in the desired finish color, and/or covered with a 3 mm thick white pvc edgebanding.

As shown in FIGS. 4 and 5, the fixed shelf 100 could rest on top of mounting brackets 160, 180 or any other mounting structure. For example, the fixed shelf 100 could rest on top of brackets, pegs, support strips, etc.

Figure 6:
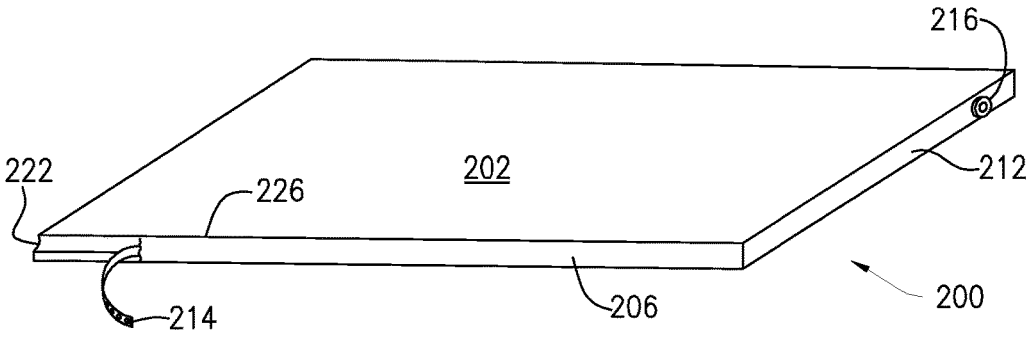
FIG. 6 is a top front perspective view of a surface mounted light.
Figure 7:
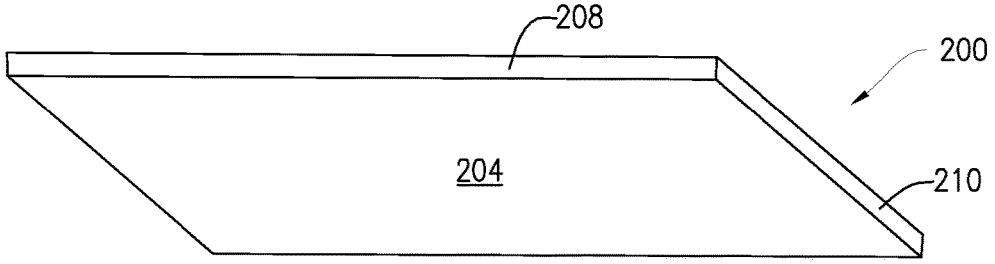
FIG. 7 is a rear back perspective view of the surface mounted light of FIG. 6.
Figure 8:
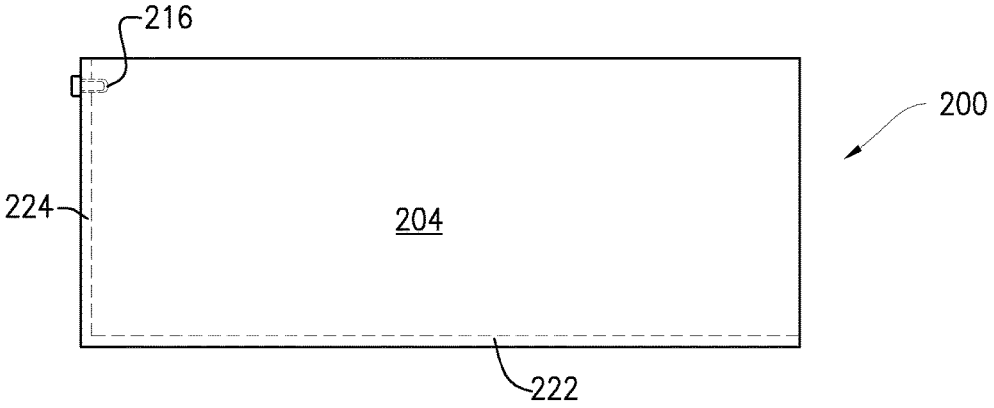
FIG. 8 is a bottom view of the surface mounted light of FIG. 6.

FIGS. 6-8 are views of a surface mounted light 200 for a shelving unit. More specifically, FIG. 6 is a top front perspective view of a surface mounted light 200, FIG. 7 is a rear back perspective view of the surface mounted light 200 of FIG. 6, and FIG. 8 is a bottom view of the surface mounted light 200 of FIG. 6. The surface mounted light 200 includes the same features and/or materials as the fixed shelf described in FIGS. 1-5, except where otherwise noted.

The surface mounted light 200 could be thinner and lighter than the fixed shelf 100 of FIGS. 1-5. The surface mounted light could be mounted (e.g., by an adhesive) to a bottom surface (e.g., of a shelf, of a cabinet, etc.).

As shown in FIGS. 6-8, the surface mounted light 200 has a top side 202, bottom side 204, front side 206, rear side 208, left side 210, and right side 212. The surface mounted light 200 can be formed from any material that is clear or sufficiently clear enough such that light provided by light source 214, for example, an LED lighting strip (discussed hereinbelow) travels throughout the material without experiencing significant distortion or scattering. For example, the light 200 could be made of acrylic, fiberglass, polyurethane, or any other material of sufficient durability and clarity. In order to diffuse the light output of light 200, the bottom side 204 of the light 200 could be altered (e.g., sand blasted, roughened with sandpaper, etc.) such that the bottom side 204 is transparent or translucent, such that the light is scattered evenly down from the light 200.

The light 200 could include an LED lighting strip 214 disposed along the front side 206 of the light 200. The LED lighting strip 214 faces inward (e.g., toward the center of the light 200), thereby transmitting the light provided by the lighting strip 214 through the light 200 itself. The LED lighting strip 214 could be a 5630 smd LED (e.g., white, 38 lm per LED, 60 LEDs per meter on a 6 mm pcb strip), a 2835 smd LED (e.g., white, 120 LEDs per meter), or any other suitable lighting strip. The LED lighting strip 214 could include white lights or a variety of shades of white, and/or a combination of colors (e.g., red, green, blue, etc.), which in combination can provide white light or can be used separately to create color effects. As shown in FIGS. 6 and 8, the LED lighting strip 214 could include at least one female connector jack 216 (configured to receive a male connector jack of a power supply) and a supply wire (not shown), or the light strip 214 could otherwise be connected to a power supply.

According to some aspects of the present disclosure, the LED light strip 214 could include additional female connectors 216 at each rear corner and/or side of the light 200 where a power supply or an additional light unit could be connected. Further the connectors 216 could be configured to accept power from a power supply, and/or to provide power to an additional light 200. For example, a first female connector 216 could be coupled to a DC power supply and a second female connector 216 could be used to provide power to another light (e.g., by way of an intermediary cable), thereby allowing for an expandable system. Accordingly, the connectors 116 could allow for additional lights to be connected to the light 200, allowing multiple units to be continuous and to operate off of a single power source (e.g., daisy chaining), thereby reducing the number of cords or other infrastructure needed to operate numerous lights 200.

According to some aspects of the present disclosure, the light 200 could have a front groove 222 (e.g., chamfer) along a top front edge 226 thereof. The LED light strip 214 could be glued into the front groove 222 using a suitable adhesive, and the supply wire could be run along a side groove 224 to the female power connector 216. According to some aspects of the present disclosure, the LED light strip 214 could be affixed within the groove 222 using a double-sided bonding tape, such as for example, VHB™ adhesive acrylic tape manufactured by the 3M™ Company, or any other suitable double-sided bonding tape or adhesive. Of course, in embodiments where the light 200 has multiple connectors 216, multiple grooves 222 could be provided (e.g., a side groove 224 on each of the left and right sides of the light 200) to accept additional supply wires.

The female power connector 216 can be affixed to the light 200 in a variety of different positions. For example, as shown in FIGS. 6 and 8, the connector 216 could be mounted so that it is accessible from a side (e.g., right side 212) of the light 200. Alternatively, the connector could be mounted so that it is accessible from a different side (e.g., bottom side 204) of the light 200. According to some aspects of the present disclosure, the connector 216 could be mounted at one or more rear corners of the light 200 (see FIGS. 6 and 8).

The top side of the light 200 is laminated with white laminate (e.g., formica), facing down to reflect the light downward and the front side 106, rear side 108, left side 110, and right side 112 could be laminated with another laminate.

Figure 9:
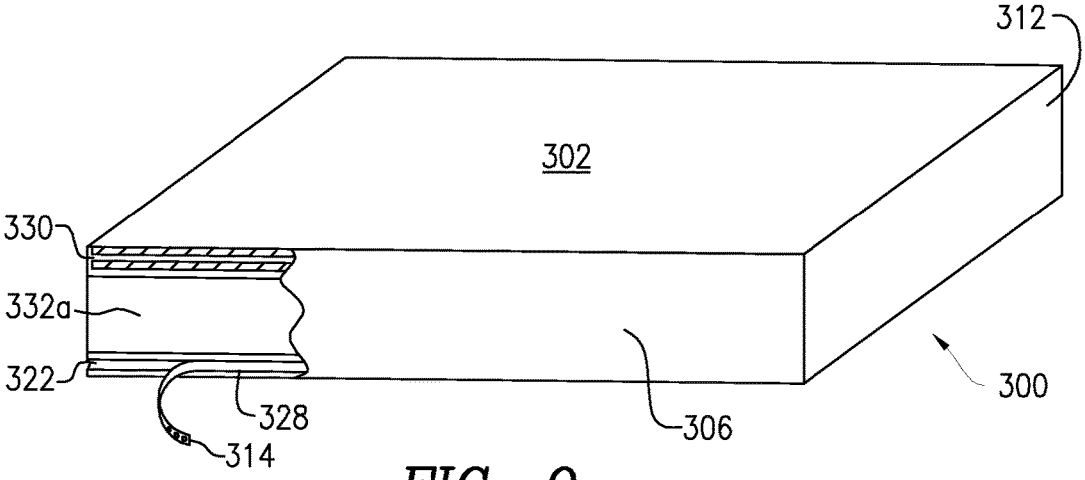
FIG. 9 is a top front perspective view of a self-lit floating shelf.
Figure 10:
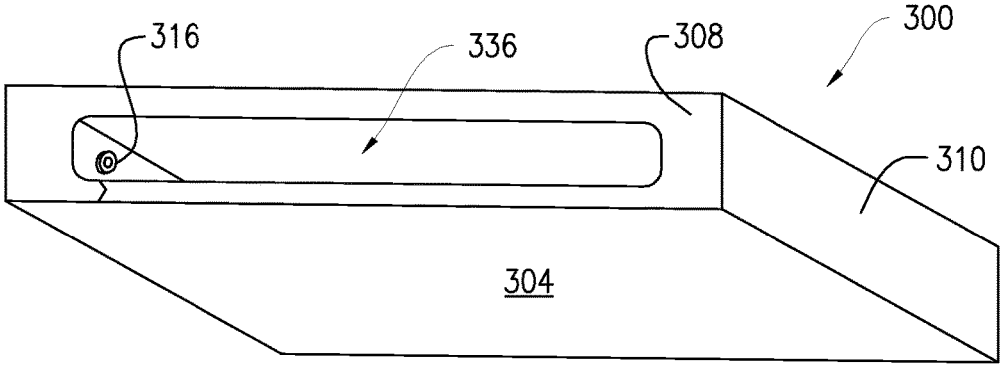
FIG. 10 is a rear back perspective view of the self-lit floating shelf of FIG. 9.
Figure 11:
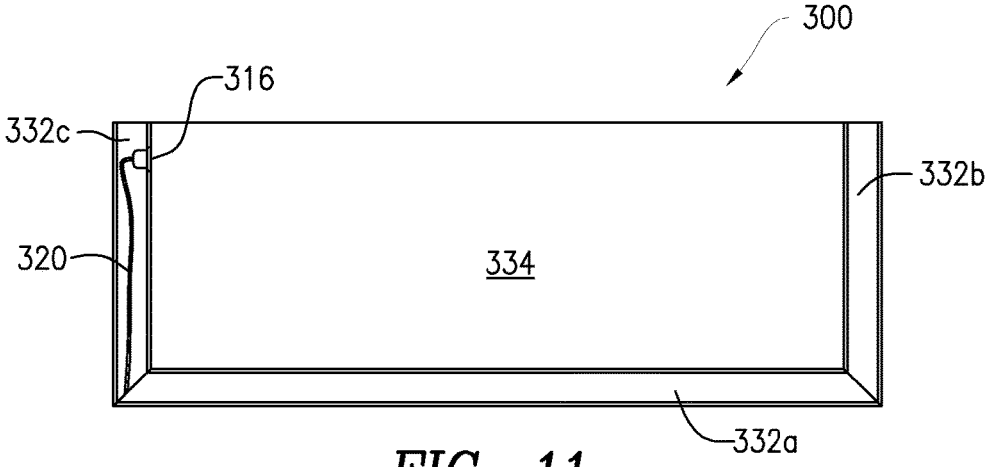
FIG. 11 is a bottom view of the self-lit floating shelf of FIG. 9.
Figure 12:
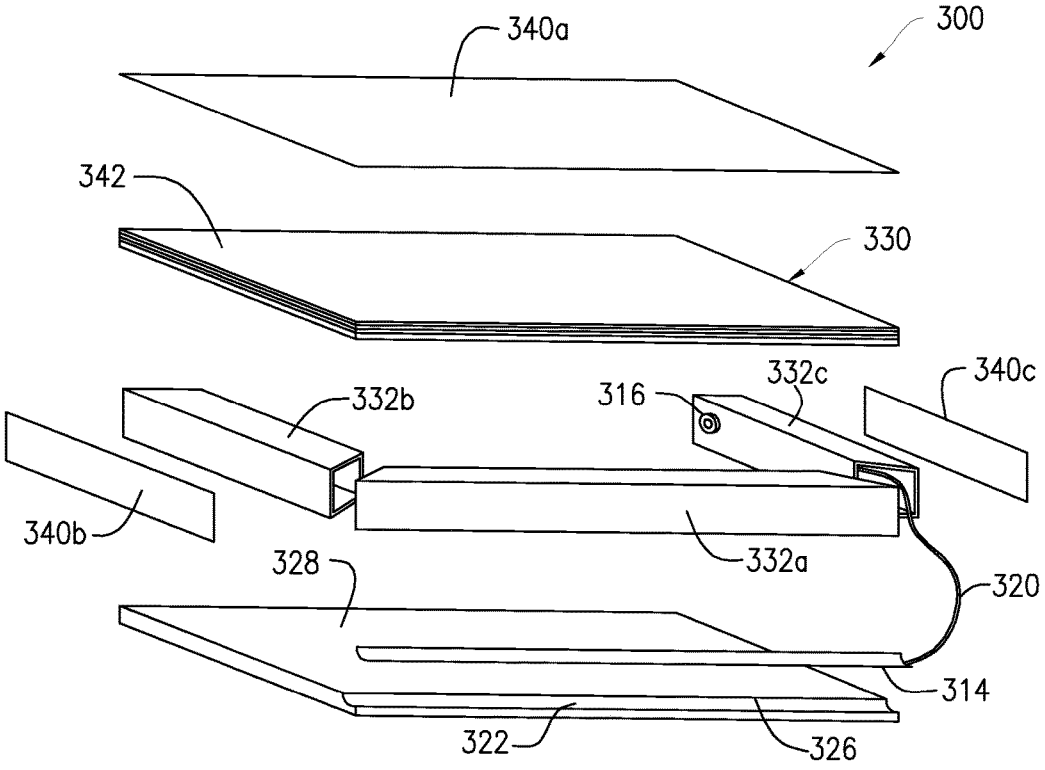
FIG. 12 is an exploded view of the self-lit floating shelf of FIG. 9.
Figure 13:
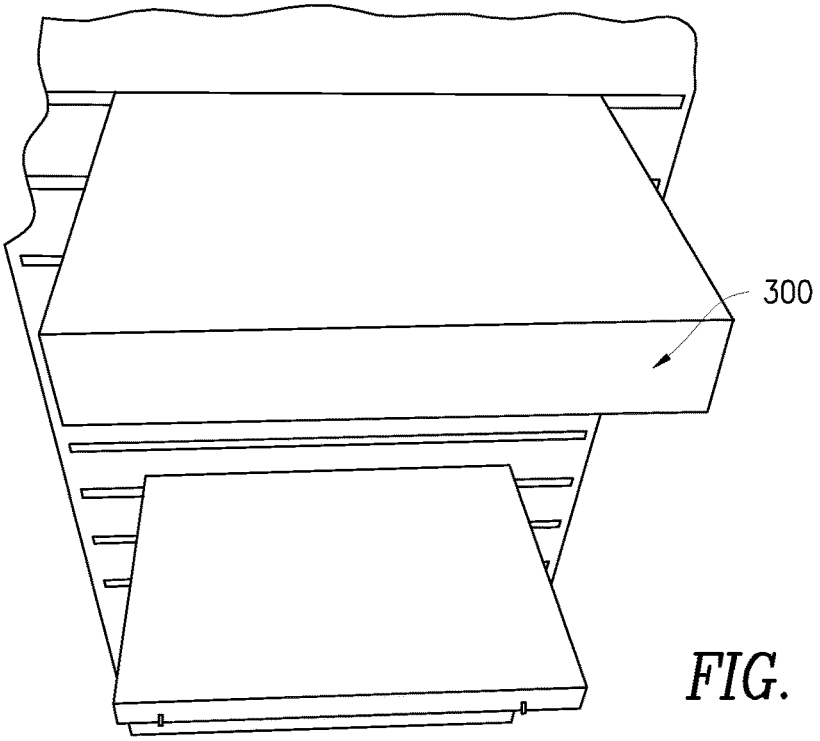
FIG. 13 is a front perspective view of the self-lit floating shelf of FIG. 9 mounted to a wall unit.
Figure 14:
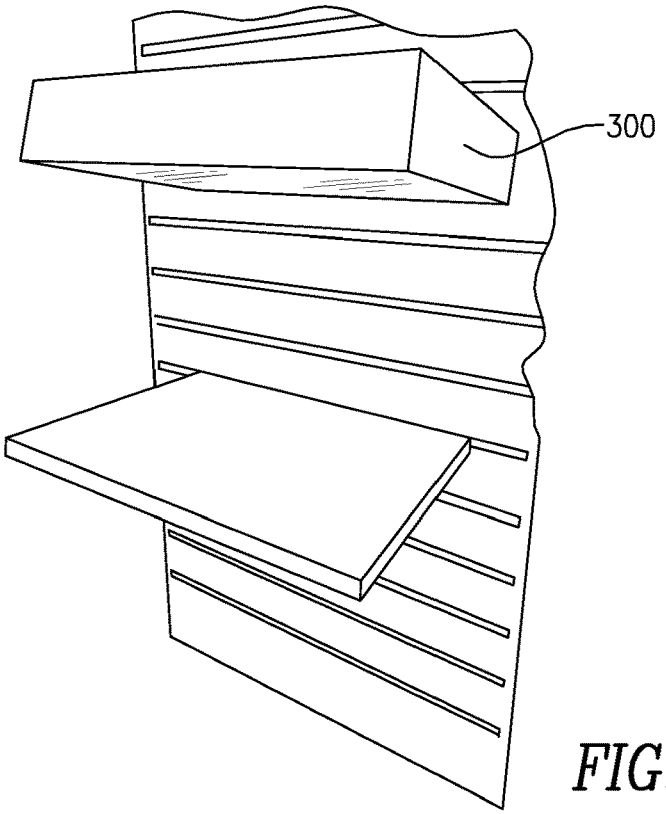
FIG. 14 is another perspective view of the self-lit floating shelf of FIG. 13.
Figure 15:
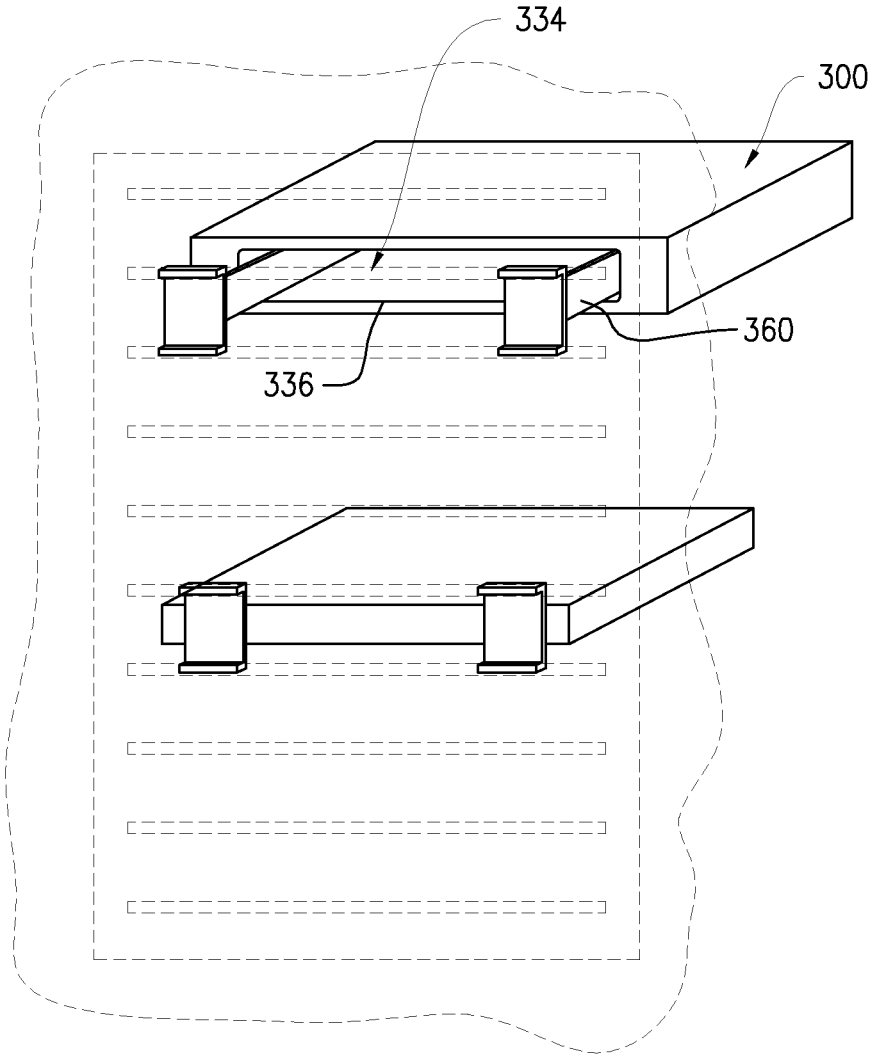
FIG. 15 is a perspective view of the self-lit floating shelf of FIG. 13 being assembled to the wall unit.

FIGS. 9-15 are views of a self-lit floating shelf 300. More specifically, FIG. 9 is a top front perspective view of a self-lit floating shelf 300, FIG. 10 is a rear back perspective view of the self-lit floating shelf 300 of FIG. 9, FIG. 11 is a bottom view of the self-lit floating shelf 300 of FIG. 9, FIG. 12 is an exploded view of the self-lit floating shelf 300 of FIG. 9, FIG. 13 is a front perspective view of the self-lit floating shelf 300 of FIG. 9 mounted to a wall unit, FIG. 14 is another perspective view of the self-lit floating shelf 300 of FIG. 13; and FIG. 15 is a perspective view of the self-lit floating shelf 300 of FIG. 13 being assembled to the wall unit. The floating shelf 300 includes the same features and/or materials as the fixed shelf described in FIGS. 1-5, except where otherwise noted. For example, the floating shelf 300 could include a top side 302, bottom side 304, front side 306, left side 310, and right side 312.

The floating shelf 300 could include a bottom layer 328 of clear Plexiglas (e.g., acrylic) having a groove 322 (e.g., or chamfer) along a top front edge 326 thereof. Groove 322 could receive LED strip 314. According to some aspects of the present disclosure, the LED light strip 314 could be affixed within the groove 322 using a double-sided bonding tape, such as for example, VHB™ adhesive acrylic tape manufactured by the 3M™ Company, or any other suitable double-sided bonding tape or adhesive. A top layer 330 of plywood (e.g., ½ inch) could be positioned over the bottom layer, with one or more spacers 332*a-c* therebetween. The spacers 332*a-c* could be aluminum tubing, such as square aluminum tubing (e.g., 1.5 inches). The spacers could be positioned along the front, left, and right edges of the top and bottom layers, thereby defining a pocket 334 and rear opening 336 (see FIG. 15) therebetween. A power jack 316 could be positioned on an inner front surface 338 of one of the spacers 332*a-c*, and electrical wiring 320 could be fed through the spacer 332*a-c* to the LED strip 314. Additionally, a laminate 340*a-c* could be positioned on a top surface 342 of the top layer 330, a left surface of a left spacer 332*b*, and a right surface of a right spacer 332.

The floating shelf 300 includes a pocket 334 having an opening 336 in a back side 308 of the floating shelf 300. The pocket 334 receives mounting brackets 360 (or other mounting components) to hide the mounting components 360 therein.

FIGS. 16 and 17 are perspective views of the self-lit fixed shelf 100 shown in FIGS. 1-3. More specifically, FIG. 16 is a partial bottom exploded view of the self-lit fixed shelf 100, and FIG. 17 is a partial top exploded view of the self-lit fixed shelf 100.

As shown in FIGS. 16 and 17, the shelf 100 could include top side 102, bottom side 104, front side 106, rear side 108, left side 110, and right side 112. The self-lit shelf 100 includes an LED lighting strip 114 along a front side 106 of the shelf 100. A female connector 116 for receiving power from a power source (not shown) is coupled to the LED lighting strip 114 by way of a supply wire 120. As shown in FIG. 16, the shelf 100 could be provided with a groove 122 in the front side 106 of the shelf for receiving the LED light strip 114. The shelf 100 could also be provided with a groove 124 on at least one side (e.g., left side 110 and/or right side 112) of the shelf 100 to receive the supply wire 120. According to some aspects of the present disclosure, a first aperture 142 for receiving the female power connector 116 is disposed in the bottom side 104 of the shelf 100 and a second aperture 144 is disposed on at least one side (e.g., left side 110 and/or right side 112) of the shelf 100, so that the first and second apertures 142, 144 intersect. Accordingly, the supply wire 120 can be run along groove 124 and through aperture 144 so that the supply wire 120 can couple the LED lighting strip 114 to the female connector 116 without disturbing the external appearance of the shelf 100. The first and second apertures could at one, or any/all, corner(s) of the shelf 100.

As shown in FIG. 17, one or more of the top side 102, front side 106, rear side 108, left side 110, and right side 112 of shelf 100 could be laminated. For example, the sides could be laminated with a white laminate 140*a-e* (e.g., formica) which faces inward (e.g., towards a center of the shelf 100) and assists in reflection of light. Additionally, the shelf 100 could be provided with a second layer of laminate 146*a-e* which is disposed on top of the first layer of laminate 140*a-e*. The second layer of laminate 146*a-e* could provide the desired finish and color (e.g., 3 mm thick white PVC edgebanding).

Figure 18A:
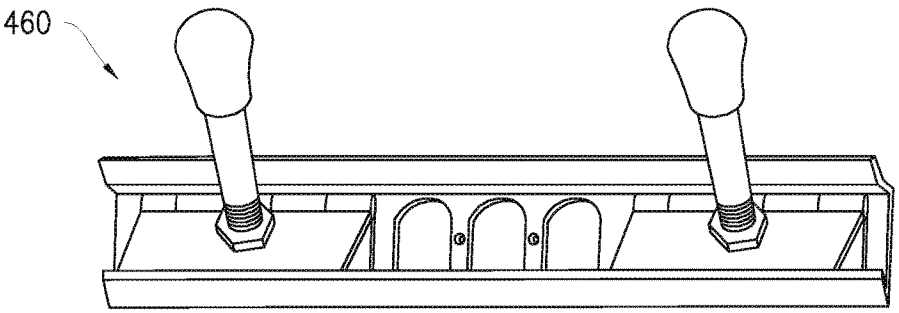
FIGS. 18A-D are views of a mounting bracket.
Figure 18B:
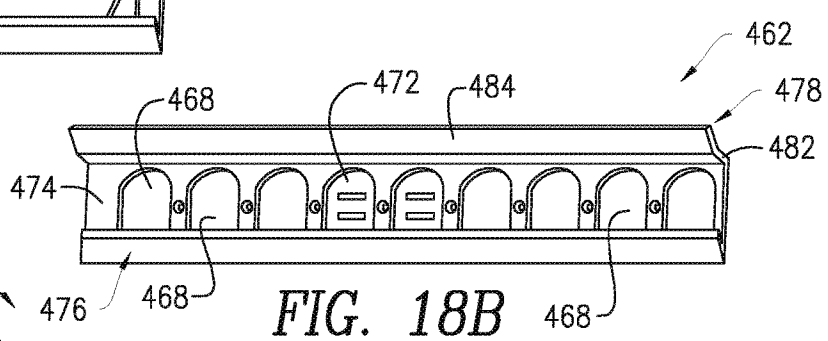
Figure 18C:
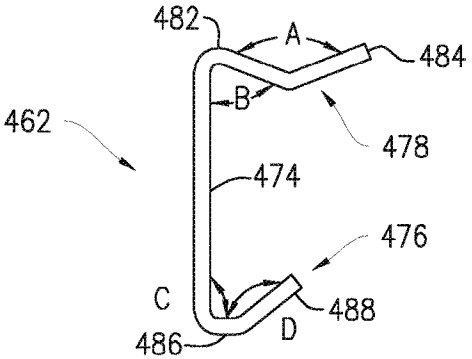
Figure 18D:
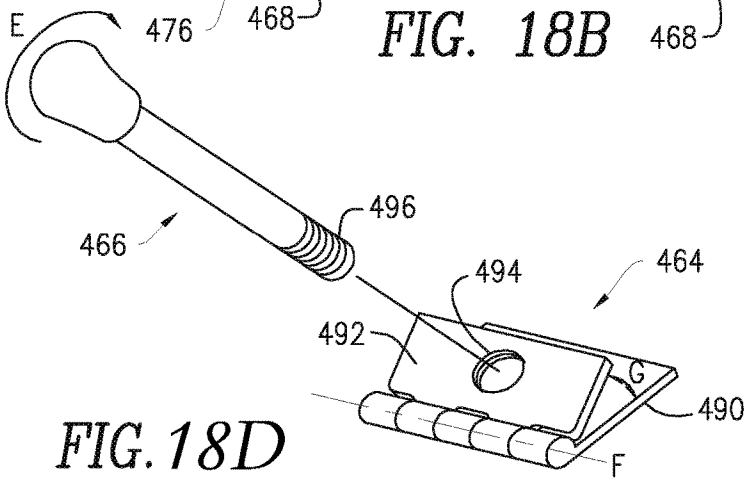

FIGS. 18A-D show a mounting bracket 460 according to another aspect of the present disclosure. More specifically, FIG. 18A is a perspective view of the mounting bracket 460, FIG. 18B is a perspective view of a wall harness 462 of the mounting bracket 460, FIG. 18C is a cross-sectional view of the wall harness 462, and FIG. 18D is a perspective view of a hinge 464 and support rod 466 of the mounting bracket 460.

Figure 19A:
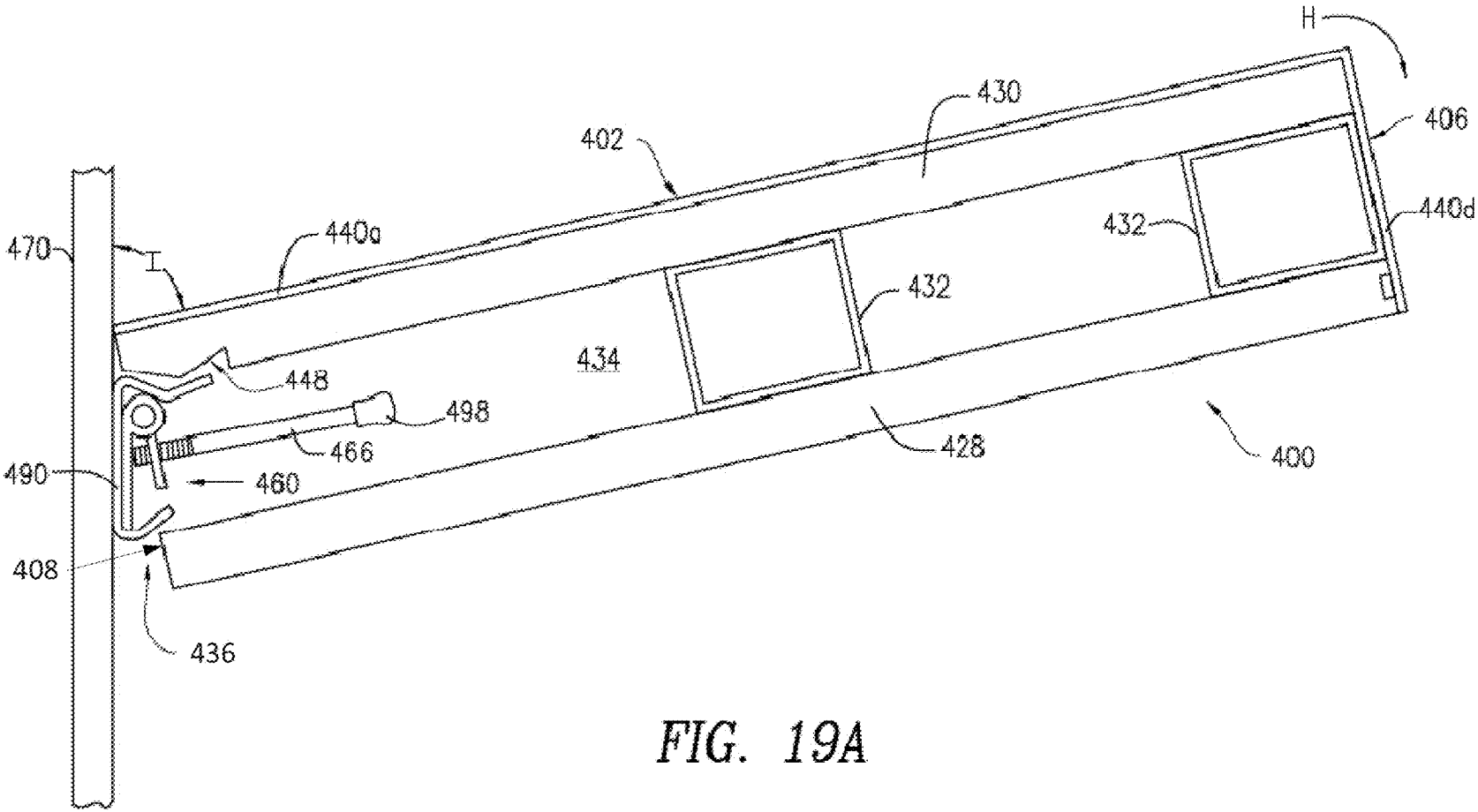
FIGS. 19A and 19B are cross-sectional views of a floating shelf mounted to a wall using the mounting bracket of FIGS. 18A-D.

Mounting bracket 460 can be used to attach floating shelf 400 to a wall 470 (see FIGS. 19A and B). Mounting bracket 460 includes wall harness 462, hinge 464, and support rod 466. As shown in FIG. 18B, wall harness 462 is provided with a plurality of apertures 468 configured to receive a pair of standard electrical outlets 472. Accordingly, the wall harness 462 can be mounted to a wall 470 (e.g., using screws or the like) on top of an existing standard electrical outlet 472. Importantly, the electrical outlets 472 can be accessed through the apertures 468 when the mounting bracket is fully assembled and the outlets 472 can be positioned anywhere along the length of the bracket. The wall harness 462 could be made from a single piece of sheet metal or from a plurality of components. The wall harness includes a back plate 474, a lower bracket, indicated generally at 476, extending from a bottom edge of the back plate 474, and an upper bracket, indicated generally at 478, extending from a top edge of the back plate. The lower bracket 476 can include first portion 486 which extends from the bottom edge of the back plate 474 and a second portion 488 which extends at an angle from the first portion 486. The upper bracket 478 can include first portion 482 which extends from the top of the back plate 474 and a second portion 484 which extends at an angle from the first portion 482.

FIG. 18C shows a configuration of wall harness 462 according to some aspects of the present disclosure. First portion 482 and second portion 484 of upper bracket 478 could form an angle relative to each other (e.g., about 120 degrees) as indicated by arrow A, first portion 482 of upper bracket 478 and back plate 474 could form an angle relative to each (e.g., about 60 degrees) other as indicated by arrow B, back plate 474 and first portion 486 of lower bracket 476 could form an angle relative to each other (e.g., about 90 degrees) as indicated by arrow C, and first portion 486 and second portion 488 of lower bracket 476 could form an angle relative to each other (e.g., about 135 degrees) as indicated by arrow D.

FIG. 18D shows hinge 464 and support rod 466 of mounting bracket 460. Hinge 460 can include a fixed portion 490 and a rotatable portion 492. Rotatable portion 492 can be provided with a threaded aperture 494 for receiving a threaded portion 496 of support rod 466. Support rod 466 is provided with the threaded portion 496 on a first end and could have a bumper 498 (e.g., rubber foot) on the opposite end. When the threaded portion 496 of the support rod 466 is threaded into the aperture 494, the end of support rod 466 that is proximate to the threaded portion 496 will bear against fixed portion 490 (e.g., due to gravity). The support rod 466 can be further advanced through the rotatable portion 492 by rotating support rod in the direction indicated by arrow E (e.g., clockwise about its axis). Conversely, the support rod 466 can be removed from the rotatable portion 492 by rotating support rod 466 opposite the direction indicated by arrow E (e.g., counterclockwise about its axis). Accordingly, as the support rod 466 is rotated, rotatable portion 492 of hinge 464 is rotated about the axis indicated by arrow F and the smallest permitted angle between fixed portion 490 and rotatable portion 492, indicated by arrow G, is altered. The amount of rotation of the support rod 466 could be limited by use of a collar (e.g., a hexagonal nut) disposed around the threaded portion 496 of the support rod 466 at a predetermined location, thereby limiting mobility of the rotatable portion 492 of the hinge 464. According to some aspects of the present disclosure, the collar (e.g., hexagonal nut) disposed around the threaded portion 496 could be sized and shaped to provide additional grip (e.g., as compared to a threaded portion 496 having no collar), thereby assisting a user in rotating the support rod 466. The support rod 466 and hinge 464 could be of a unitary construction and other adjustment mechanisms could be used to limit angle G.

Figure 19B:
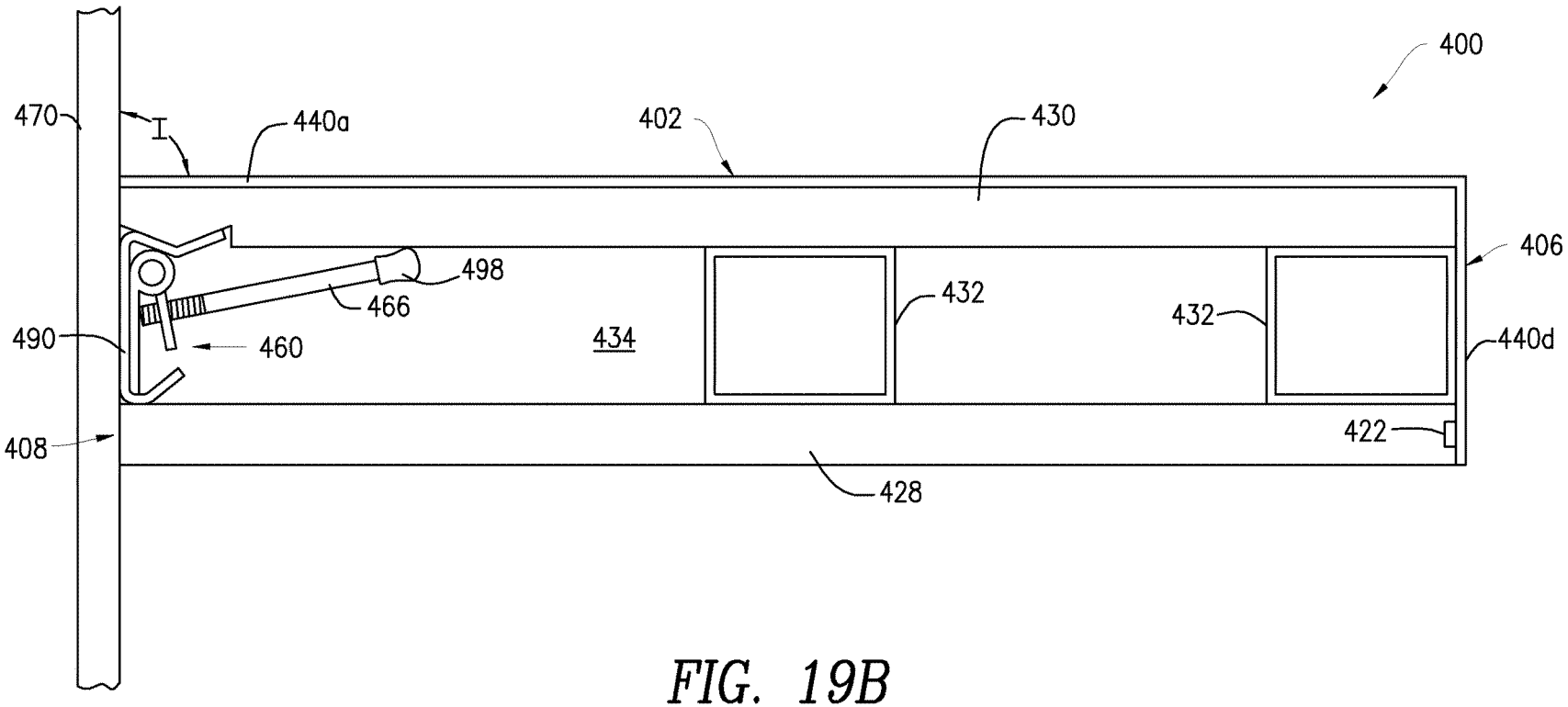

As shown in FIGS. 18A, 19A, and 19B, fixed portion 490 of hinge 464 is restrained from movement normal to (e.g., perpendicular to or away from) back plate 474 by lower bracket 476 and upper bracket 478. However, fixed portion 490 may be slidably movable parallel to, and along, back plate 474. This would provide an installer with flexibility in positioning the mounting bracket 460. For example, the electrical outlet 472 may not be centered where the installer desires to hang the floating shelf 400. Instead of having to move a preexisting outlet, the installer can mount the wall harness 462, centered on the desired location, aligning any of the appropriate apertures 468 to with the electrical outlet 472. Once the wall harness 462 is mounted on the wall, the hinges 464 can be positioned to an appropriate location along the length of the wall harness 462 where they do not obstruct the electrical outlet 472.

FIGS. 19A and 19B show another aspect of the present disclosure. More specifically, FIG. 19A is a cross-sectional view of the mounting bracket 460 and floating shelf 400 in a first position and FIG. 19B is a cross-sectional view of the mounting bracket 460 and floating shelf 400 in a second position.

The floating shelf, indicated generally at 400, includes the same features and/or materials as the floating shelf 300 described in connection with FIGS. 9-15, except where otherwise noted. The floating shelf 400 could include a bottom layer 428 of clear Plexiglas (e.g., acrylic) having a groove 422 (e.g., or chamfer) along a front side 406 thereof. Groove 422 could receive an LED lighting strip (not shown). According to some aspects of the present disclosure, the LED light strip could be affixed within the groove 422 using a double-sided bonding tape, such as for example, VHB™ adhesive acrylic tape manufactured by the 3M™ Company, or any other suitable double-sided bonding tape or adhesive. A top layer 430 of plywood (e.g., ½ inch) could be positioned over the bottom layer 428, with one or more spacers 432 therebetween. The spacers 432 could be aluminum tubing, such as square aluminum tubing (e.g., 1.5 inches). The spacers 432 could be positioned along the front, left, and right edges and center of the top and bottom layers 428,430, thereby defining a pocket 434 and rear opening 436 therebetween. A power jack could be positioned on an inner surface of one of the spacers 432, or anywhere in the pocket 434, and electrical wiring could be fed through the spacer 432 to the LED strip. A laminate 440*a,d* could be positioned on the top side 402, front side 406, left side (not shown), right side (not shown), and rear side (not shown) of the shelf 400. As shown in FIG. 19B, floating shelf 400 could include a mounting groove 448 which extends laterally between the left and right sides of the floating shelf 400. Importantly, the profile of the mounting groove 448 is sized and shaped to receive and mate with the upper bracket 478 of the mounting bracket 460.

The floating shelf 400 includes pocket 434 having opening 436 in the back side 408 of the floating shelf 400. As shown in FIGS. 19A and 19B, the pocket 434 receives mounting bracket 460, discussed herein. In order mount the floating shelf 400 onto the mounting bracket 460, the floating shelf 400 is first positioned according to the configuration shown in FIG. 19A (e.g., the shelf 400 being obliquely positioned relative to the wall 470, the upper bracket 478 of the mounting bracket 460 being at least partially positioned in the pocket 434 through the opening 436 of the shelf 400, and the front side 406 of top layer 430 being positioned at the intersection of the wall 470 and the mounting bracket 460). Once the shelf 400 is so positioned, the shelf 400 is rotated in the direction as indicated by arrow H until the shelf 400 is fully engaged in its second, and final, position (e.g., normal to, or about normal to, wall 470) as shown in FIG. 19B.

The angle of the shelf, as indicated by arrow I, is at least partially determined according to the position of support rods 466. As previously discussed herein, the angle G (see FIG. 18D) between the fixed portion 490 and the rotatable portion 492 of the hinge 464 can be varied by rotating the support rods 466. As shown in FIG. 19B, when the shelf 400 is fully engaged with the mounting bracket 460, the bumper 498 of the support rod 466 is frictionally engaged with an underside of the top layer 430 and provides support for the shelf 400. By rotating the support rods 466, the angle of the support rods 466 (e.g., relative to the wall 470) is altered, the point at which the bumper engages the underside of the top layer 430 is altered, and thus, angle I is altered. Accordingly, an installer or user of the shelf 400 can easily adjust the angle I of the shelf 400 by simply rotating the support rods 466 of the mounting bracket 460 and reattaching the floating shelf 400.

Having thus described the disclosure in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

The invention claimed is:

1. A floating shelf mounting system comprising:

a floating shelf and a mounting bracket, the floating shelf comprising:

a bottom layer formed from an at least partially transparent material and having a groove on a front side of the bottom layer;

a lighting strip positioned within the groove and facing towards a rear side of the bottom layer;

a reflective laminate adhered to front, rear, lateral, and top sides of the bottom layer;

a top layer having a groove on an underside of the top layer, the groove extending between left and right sides of the top layer and sized and shaped for receiving an upper bracket of the mounting bracket;

spacers positioned between the bottom layer and the top layer, the spacers, bottom layer, and top layer defining a pocket; and a power connector positioned on an interior side of a spacer and configured to provide power to the lighting strip;

the mounting bracket comprising:

a wall harness having a back plate, an upper bracket, and a lower bracket, the back plate being provided with a plurality of apertures sized to provide access to electrical outlets;

a hinge having a fixed portion and a movable portion;

a support rod attached to the movable portion, the support rod having distal ends that extend into the pocket of the floating shelf and bear against the top layer; and the fixed portion of the hinge being restrained against the back plate of the wall harness by the upper bracket and lower bracket.

2. The system of claim 1, wherein an angle between the fixed portion and the movable portion is adjustable by rotating the support rod.

3. The system of claim 1, wherein the support rod comprises first and second support rods each having a bumper opposite a threaded portion.

4. The system of claim 3, wherein the bumpers of the first and second support rods frictionally engage the top layer of the floating shelf when the groove of the top layer receives the upper bracket.

5. The system of claim 1, wherein the hinge comprises first and second hinges, fixed portion of each hinge slidably movable along a length of the wall harness.

* * * * *